US007178743B2

(12) United States Patent
Clarke, III et al.

(10) Patent No.: US 7,178,743 B2
(45) Date of Patent: Feb. 20, 2007

(54) PORTABLE SPRAYER

(75) Inventors: J. Lyell Clarke, III, St. Charles, IL (US); Anthony Kevin Magro, Fox River Grove, IL (US); Daniel K. Childs, Chicago, IL (US); Julie Bates, Arlington Heights, IL (US)

(73) Assignee: Clarke Consumer Products, Inc., Roselle, IL (US)

( * ) Notice: Subject to any disclaimer, the term of this patent is extended or adjusted under 35 U.S.C. 154(b) by 210 days.

(21) Appl. No.: 10/879,611

(22) Filed: Jun. 29, 2004

(65) Prior Publication Data

US 2005/0284958 A1 Dec. 29, 2005

(51) Int. Cl.
*A62C 13/62* (2006.01)

(52) U.S. Cl. ..... 239/304; 239/351; 239/355; 239/398; 239/416.3

(58) Field of Classification Search ..... 239/351, 239/353, 355, 358, 398, 416.3
See application file for complete search history.

(56) References Cited

U.S. PATENT DOCUMENTS 2,888,207 A * 5/1959 Sykes ..... 239/301
3,793,763 A 2/1974 Griffin et al.
3,917,168 A * 11/1975 Tenney ..... 239/13
3,926,369 A 12/1975 Pearce
3,937,402 A 2/1976 Query
4,050,629 A 9/1977 Query et al.
4,272,019 A 6/1981 Halaby, Jr.
4,671,435 A 6/1987 Stout et al.
5,248,448 A 9/1993 Waldron et al.
5,269,461 A 12/1993 Davis
5,566,502 A 10/1996 Shigetoyo
6,032,407 A 3/2000 Conner
6,152,382 A 11/2000 Pun
6,164,560 A 12/2000 Lehrke et al.
6,206,300 B1 * 3/2001 Roudebush et al. ..... 239/77
6,375,089 B1 4/2002 Taylor et al.
6,378,789 B1 * 4/2002 Seaman et al. ..... 239/443
6,443,434 B1 9/2002 Prather
6,669,105 B2 * 12/2003 Bryan et al. ..... 239/61
6,742,718 B2 * 6/2004 Doebler et al. ..... 239/67
6,820,821 B2 * 11/2004 Linstedt et al. ..... 239/222.11
2001/0050317 A1 12/2001 Denen
2002/0020756 A1 2/2002 Yahav
2002/0030117 A1 3/2002 Bryan et al.
2002/0100819 A1 8/2002 Taylor et al.
2002/0130146 A1 9/2002 Borut et al.
2003/0071144 A1 * 4/2003 Naemura ..... 239/390
2003/0132311 A1 7/2003 Dorendorf et al.
2003/0160062 A1 8/2003 Inoue et al.
2003/0177841 A1 9/2003 Skinner
2003/0192959 A1 10/2003 Hess et al.
2005/0194467 A1 * 9/2005 Wanbaugh et al. ..... 239/333

* cited by examiner

*Primary Examiner*—Kevin Shaver
*Assistant Examiner*—Trevor McGraw
(74) *Attorney, Agent, or Firm*—Cook, Alex, McFarron, Manzo, Cummings & Mehler, Ltd.

(57) ABSTRACT

A portable, battery-powered sprayer for dispensing two liquid products at the same time includes first and second nozzles which receive first and second liquids and first and second air supplies. The nozzles are arranged to dispense the liquids at different flow rates, with different droplet sizes, and into different target zones. A low battery sensor prevents operation when the batteries have insufficient power to produce the intended flow rates and droplet sizes.

66 Claims, 6 Drawing Sheets

PORTABLE SPRAYER

BACKGROUND OF THE INVENTION

This invention relates to a portable sprayer and is particularly concerned with a sprayer for treating an area with two different products in a single pass. The sprayer is particularly adapted for applying mosquito control products, although its use is not limited to this application.

The most effective treatment of an area for mosquito control results from the application of two products. The first product, known as a knockdown product or knockdown treatment, is designed to kill mosquitoes already in a treatment zone. It is most effective when applied as an ultra low volume (ULV) spray or fog with small, lightweight droplet sizes. The second product, known as a barrier product or barrier treatment, is designed to prevent mosquitoes from entering the treatment zone. It is best applied in larger, heavier droplet sizes that impinges on plants and foliage with a material that repels and/or kills mosquitoes. The difference in required droplet sizes for the knockdown product and barrier product dictates that two separate nozzles be used to distribute the two products. This has been done commercially with a variety of units, all having separate sprayers.

Some prior art ULV sprayers of this type are mounted on a truck and are engine-powered. Similarly, truck-mounted mist blowers having very large blasts of air are powered by gasoline engines. With these types of units mounted on trucks there is ample space to accommodate separate nozzles and ample power available to drive them. Such is not the case with sprayers intended for household or consumer use. Other prior art sprayers have ULV nozzles in a hand-held unit powered by a small gasoline engine or an electric motor using a power cord. There are also prior art barrier product sprayers that supply a liquid stream only. That is, there is no air mixed with the liquid. These are available for nursery and household use in both truck-mounted and hand-cart mounted units. They are powered both by gasoline engines and electric motors, including battery powered motors.

Household sprayers need to be portable, preferably hand-held units which do not require an electrical cord. Because of these limitations in portable units, the conventional practice in household sprayers has been to make two separate passes with two separate nozzles, one for applying the knockdown product and one for applying the barrier product. Obviously, this is not the most convenient arrangement since making two passes takes twice as long as making one pass. Also, with this conventional practice either two entirely separate sprayers must be used or a single sprayer must have its nozzle and product supply reservoir changed after the first pass. Neither of these arrangements is optimal.

Furthermore, it is desirable to use battery power for household sprayers because rechargeable batteries are more convenient to use compared to units powered by gasoline engines or household current, the latter requiring a long, unwieldy extension cord. While hand-held, battery-powered sprayers are preferable from a convenience standpoint, the batteries are limited in the amount of power they can supply so the sprayer must be designed to minimize power use and make changing the battery pack simple and quick. It has not previously been feasible to have a dual-output sprayer including a ULV nozzle in a hand-held, battery-powered unit.

SUMMARY OF THE INVENTION

A primary object of the present invention is a portable sprayer having dual output nozzles for applying two separate products at the same time.

Another object of the invention is a sprayer of the type described in which the nozzles produce different droplet sizes.

Yet another object of the invention is a sprayer which is battery powered.

A further object of the invention is a sprayer having dual product chambers with quick connect fluid connectors between the chambers and the fluid lines supplying product to the pump.

Still another object of the invention is a sprayer of the type described which detects a low voltage condition in the batteries and prevents operation of the unit under such conditions.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

DETAILED DESCRIPTION OF THE INVENTION

Figure 1:
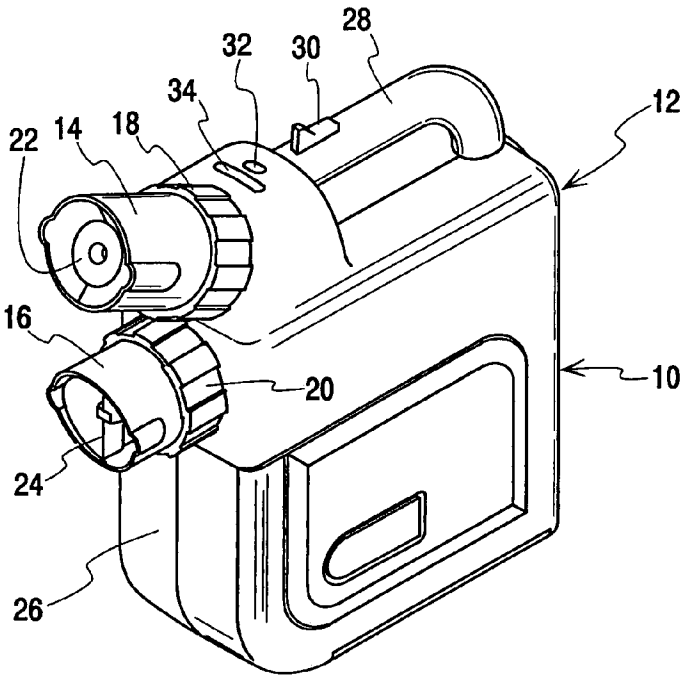
FIG. 1 is a perspective view of the sprayer of the present invention.

The portable sprayer of the present invention is shown generally at 10 in FIG. 1. The sprayer includes a housing 12 in which most of the sprayer components are contained. The most prominent components visible on the exterior of the housing are the shrouds 14, 16 of the first and second spray nozzles. The shrouds protrude from the housing 12. They have a ledge that engages the interior of the housing to keep the shrouds from being pulled out of the housing. Knurled collars 18, 20 engage the shrouds to prevent them from being pushed into the housing. The liquid emitter mounting brackets 22, 24 of the first and second nozzles are partially visible within the shrouds 14, 16. The liquid emitters themselves are described more fully below. Beneath the second nozzle shroud 16 there is a door 26 that provides access to a liquid reservoir compartment. This door may also function as a lever for actuating a reservoir support tray.

Other externally-visible features of the sprayer include a handle 28 and a control switch 30 on the top of the handle. In front of the switch there are a pair of openings or windows 32, 34 through which operational indicators can be viewed. The indicators may be as simple as an LED which shows when the battery is charging. Or the indicators could include a more complicated readout showing the user the battery charge level, the amount of liquid left in the product chambers, or similar information.

Figure 2:
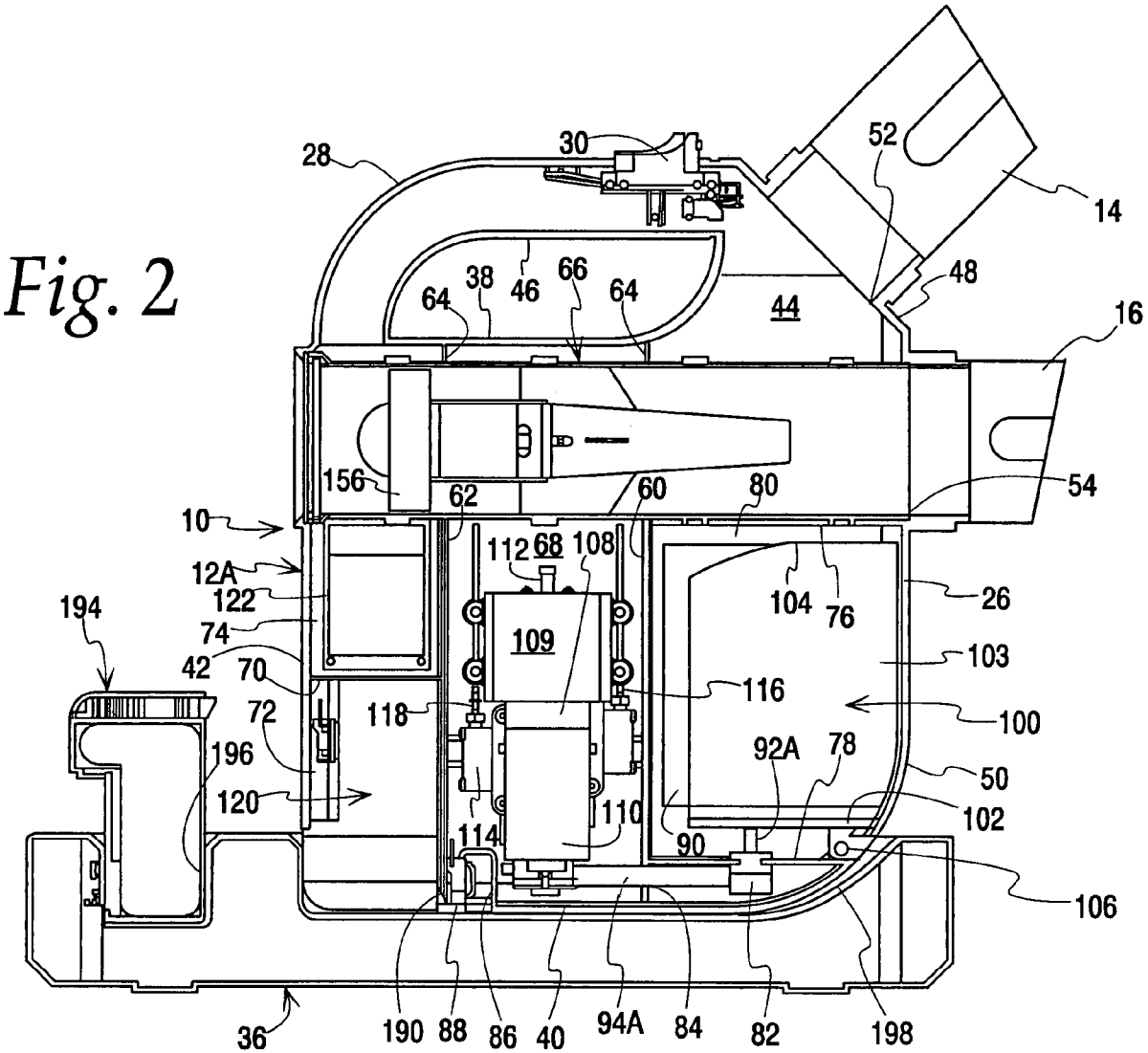
FIG. 2 is a side elevation view of the sprayer and charging cradle assembly, with some parts in section and one half of the housing case removed to expose the interior components.

The housing 12 is split vertically into two case-like halves. FIG. 2 illustrates the sprayer resting in its charging cradle 36 with one housing half removed so the internal components are visible. The housing half 12A includes a top wall 38, a bottom wall 40, a rear wall 42 and a side wall 44. The top wall 38 curves upwardly toward the front of the housing so that together with the handle 28 it defines an opening 46 that receives a user's hand. At its peak the top wall 38 slopes downwardly at an angled wall 48 to meet with the front wall 50. The door 26 forms much of the front wall. It will be noted that the handle 28 is hollow so a wiring harness (not shown) can be run through it to the control switch 30 and the indicators on top of the handle. The front of the housing has a pair of nozzle openings 52 and 54 through which the first and second nozzle 14 and 16 extend.

The housing has a plurality of internal walls or partitions that define various compartments. Front and rear vertical partitions 60, 62 each have a cutout portion 64. The cutouts receive the wind tunnel 66 as will be explained. Beneath the wind tunnel and between the vertical partitions 60, 62 there is a pump compartment 68. A divider wall 70 extends from the rear vertical partition 62 to the rear wall 42. It defines a battery compartment 72 and a control circuit compartment 74. Top and bottom horizontal walls 76, 78 join the front vertical partition 60 and extend to the front of the housing to define the liquid reservoir compartment 80. The bottom wall 78 has an opening that receives a connector support beam 82 for a quick-connect fluid connector. The female mating half of the fluid connector (not shown) is mounted in the bottom of the reservoir cartridge. Just underneath the corner of the bottom wall 78 and front vertical partition 60 are passages (one of which is shown at 84) for the fluid supply lines.

Near the junction of the rear vertical partition 62 and the bottom wall 40 there is an indentation in the bottom wall that forms a charging receptacle 86. Electrical connectors are located here to electrically connect the battery pack to a charging electrode extending upwardly from the cradle 36. At the lower left corner of the charging receptacle the bottom wall has a catch 88. The catch is engageable with a latch on the battery pack to retain the battery pack in the battery compartment 72. In this regard it will be noted that the bottom wall 40 does not extend to meet with the rear wall 42. Instead, the battery pack 120 forms the bottom rear corner of the sprayer unit when it is installed. This construction allows a user to remove and replace the battery pack with just one hand, as will be explained more fully below.

The other housing half is similar. The housing halves may be fastened together with screws or the like. Each housing half will also include a plurality of mounting posts or pads which receive screws for attachment of the various components in their respective compartments.

Figure 3:
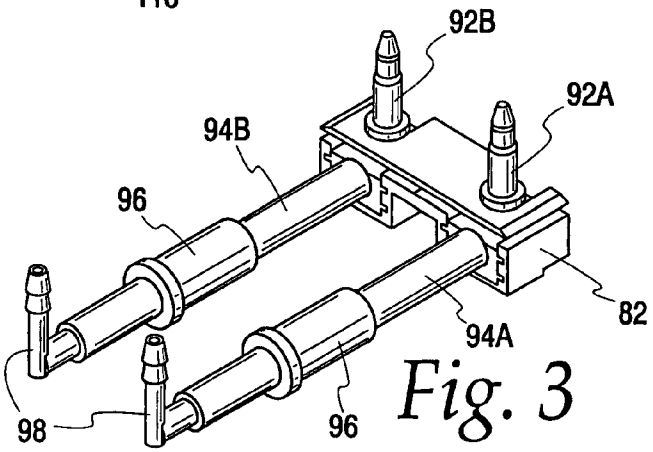
FIG. 3 is a perspective view of the reservoir cartridge connectors and supply lines.

Turning now to the components mounted in the housing, a description of the liquid reservoir cartridge will be given first. The liquid reservoir cartridge itself is partially visible at 90. The reservoir is a replaceable, twin-chamber cartridge or package. Preferably the cartridge has relatively stiff side walls, a top and a floor. Inside the cartridge are two chambers. Preferably each chamber comprises a plastic bag capable of retaining liquid therein. One of the bags will contain the chemistry for the knockdown product and the other bag will contain the chemistry for the baffler product. The floor of the reservoir cartridge has two quick-connect, female connector halves (not shown). There is one female connector for each bag and they are in fluid communication with the interior of each bag. The female connector halves mate with corresponding male quick-connect connectors 92A, 92B (FIG. 3). These connectors are mounted in the support beam 82 which in turn is fixed to the bottom wall 78 in the bottom of the reservoir compartment 80. The quick connectors may be of a type supplied by IPN of Peachtree, Ga. under their trademark Clean Clic System®. When the male and female connectors are separated, valves in the connectors prevent liquid flow through the connector halves. As seen in FIG. 3, fluid supply lines 94A, 94B are attached to the male connectors 92A, 92B. The supply lines extend through the openings 84 in the front vertical partition 60. Check valves 96 are included in the supply lines. Filters may also be incorporated in the supply lines. Elbows 98 direct the supply lines to the liquid pump heads as described below.

Inside the reservoir compartment 80 there is a tray 100 that mounts the reservoir cartridge 90. The tray has a floor 102, side walls 103 and a top wall 104. The floor is attached to a cam 106 that is pivoted to the housing walls. The cam is also connected to the front door 26. The door serves as a lever that actuates the cam 106. Opening the door through a clockwise motion (as seen in FIG. 2) about the cam's pivot causes the floor 102 to move upwardly in a linear motion. This linear motion disengages the female fluid connectors of the reservoir cartridge from the compartment's male connectors 92A, 92B. Disengaging the fluid connectors causes them to close and prevent any fluid flow through them. With the connectors disengaged, an empty reservoir cartridge can be removed from the tray 100 and replaced with a full one. Then the door 26 is closed by means of a counterclockwise motion about the cam's pivot. This causes the tray floor 102 to move downwardly. The female fluid connectors of the new, full reservoir cartridge engage the male fluid connectors 92 at the bottom of the reservoir compartment 80 to establish fluid communication between the twin chambers of the new cartridge and the fluid supply lines 94A, 94B. This provides a safe, effective and reliable way to make fluid connections without the user having to handle any of the fluid lines, connectors or the products themselves.

The next major area of the housing is the pump compartment 68. It contains a low-energy air pump 108 which is driven by an air pump motor 110. A bracket 109 mounts the air pump 108 to the housing. The air pump 108 supplies pressurized air to the first nozzle through an air pipe 112. Behind the air pump is a low energy liquid pump 114 which is driven by a liquid pump motor. The liquid pump motor is hidden in FIG. 2 behind the air pump motor 110. The liquid pump 114 is preferably a dual head diaphragm pump. Thus, one motor drives one dual head pump that supplies two separate fluids to two separate nozzles. The heads of the liquid pump are connected to the reservoir cartridge 90 by liquid supply lines 94A, 94B and the elbows 98, as seen in FIG. 3. The pump outlets are connected to nozzle supply lines or tubes. Knockdown spray line 116 connects to the first nozzle and barrier spray line 118 connects to the second nozzle.

The battery compartment 72 contains a battery pack shown generally at 120. Further details of the battery pack are described below. Connectors in the battery pack electrically connect the battery pack to the control circuit 122 which is mounted in the control circuit compartment 74. The control circuit is mounted on a printed circuit board. The printed circuit board has a power supply section that includes connectors for wires that supply electric power to the air pump motor 110 and the liquid pump motor, as well as to the fan motor 158 in the second nozzle. The printed circuit board also connects to the switch 30 in the handle and to the indicator LED's in the handle. A microcontroller is included on the printed circuit board to provide a level of intelligence that, for example, prevents operation when the battery voltage drops to a level that is incapable of producing the proper droplet sizes, when the reservoir cartridge is empty or not installed, or when the sprayer is mounted in the charging cradle. Also, the microcontroller is programmed to turn the air supply motors on before the liquid pump is activated and turn the air supply motors off after the liquid pump is shut down. This assures that liquid never flows without an accompanying air supply and any residual liquid in the emitters is blown out the nozzles and will not remain in the unit after it is turned off.

Figure 4:
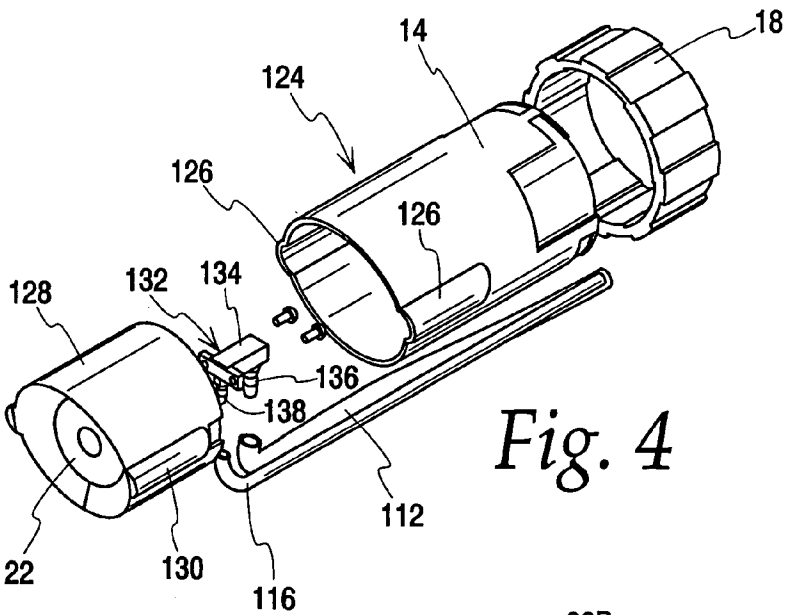
FIG. 4 is an exploded perspective view of the ULV nozzle which dispenses the knockdown product.

The first nozzle for dispensing the knockdown product is shown generally at 124 in FIG. 4. The term nozzle as used herein includes not only a liquid emitter but also a plenum for the air that is mixed with the liquid. The first nozzle is mounted in the upper portion of the housing. The axis of the nozzle is disposed at about a 45° angle to the bottom and top walls of the housing. Obviously when the housing is in its normal orientation wherein the bottom wall is parallel to the ground, then the first nozzle will dispense the knockdown product at about 45° above the ground. The nozzle 124 includes the first shroud 14 which is in the form of a generally cylindrical tube. The shroud 14 fits through the housing opening 52 and is fixed to the housing by the knurled collar 18 and the ledge on the interior of the shroud. A pair of opposed blisters 126 on the outer end of the shroud locate an emitter mounting shell 128. The shell fits telescopically into the shroud. Protrusions 130 engage the blisters 126 to provide an anti-rotation feature. The shell 128 mounts an emitter 132. This is an ultra low volume (ULY) emitter. As seen in FIG. 4, the emitter includes a body 134 with an internal passage. An air inlet 136 connects to the internal passage and the air feeder line 112 coming from the air pump 108. A liquid inlet 138 connects to the internal passage and the liquid feeder line 116 coming from one of the heads of the liquid pump 114. Downstream of the air and liquid inlets the emitter passage has a venturi (not shown). The venturi, combined with the effect of the high pressure air, breaks the knockdown liquid into droplets whose average volume median diameter is about 15 to 30 microns. This creates a fog that is ejected from the emitter in a cone-shaped pattern and permeates the surrounding area, resulting in delivery of the insecticide to mosquitoes in the vicinity. The emitter design allows creation of the small droplet sizes with a minimal power requirement. The motors driving the pumps supplying the ULY nozzle of the present invention use much less power than in prior designs. The motors supplying air and liquid to the ULV nozzle draw only about 2 to 3 amps. This is important in a portable sprayer whose only available power supply is a rechargeable battery pack.

Figure 5:
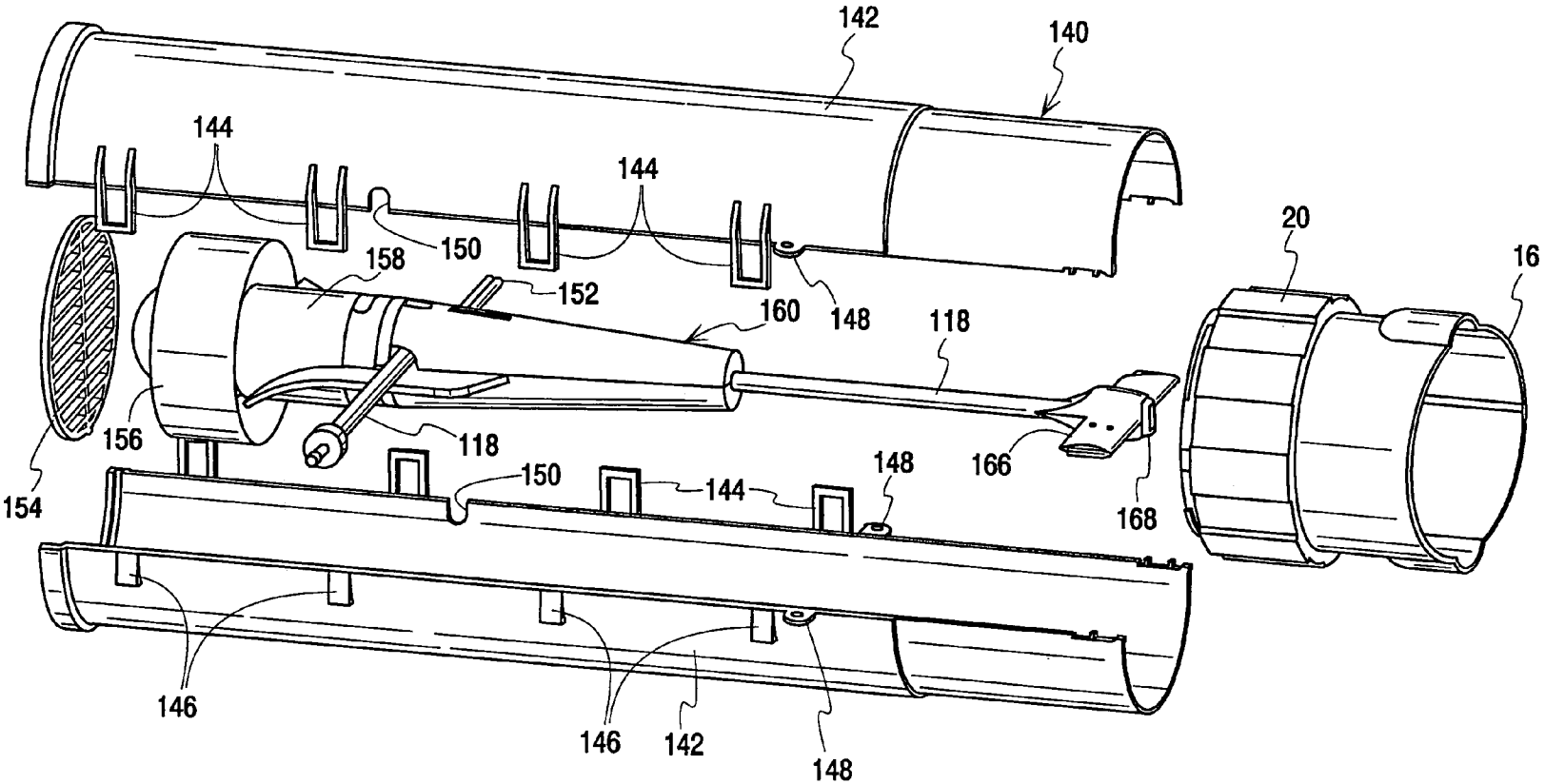
FIG. 5 is an exploded perspective view of the wind tunnel of the barrier dispensing nozzle, shown rotated about its axis 90° from its installed position.
Figure 6:
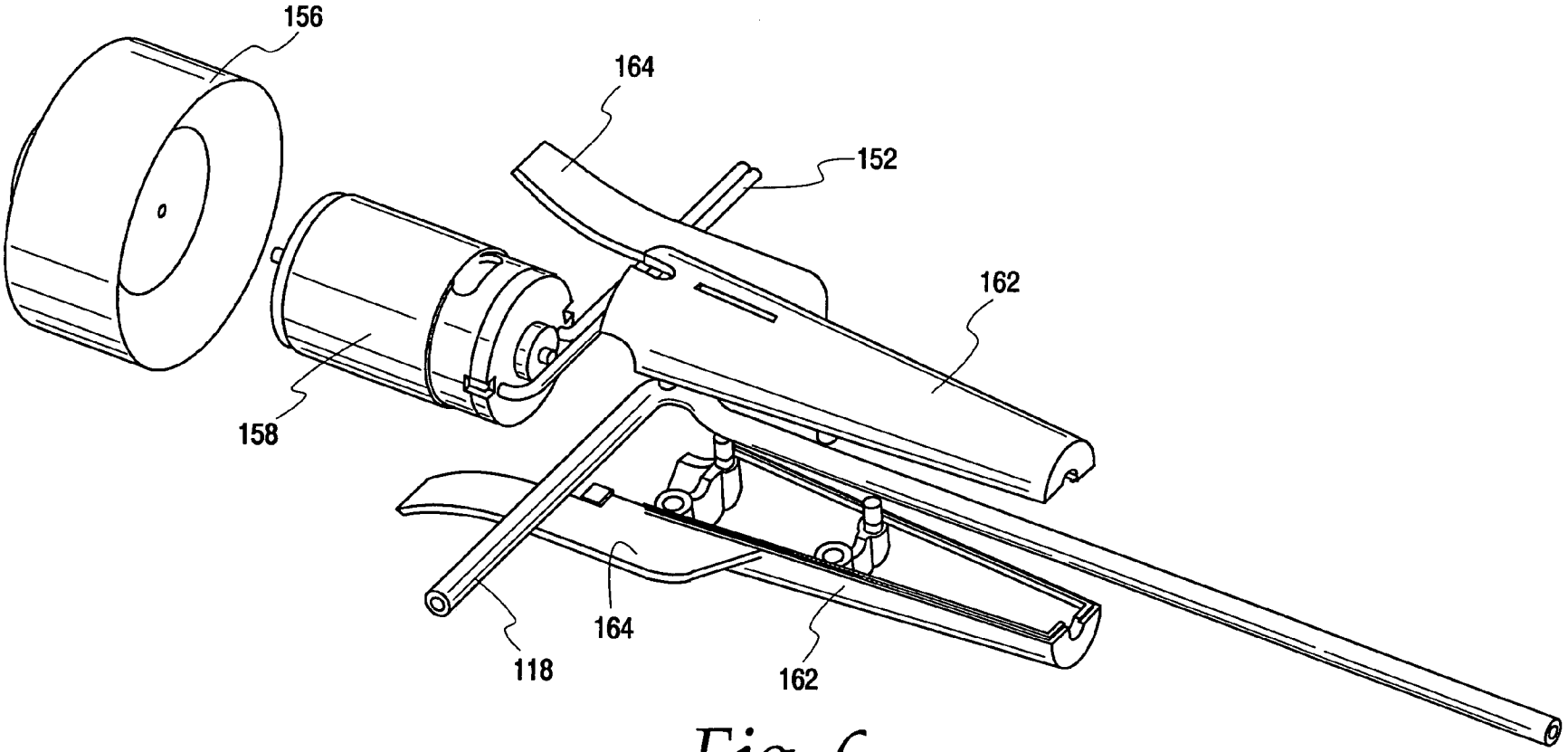
FIG. 6 is an exploded perspective view of the barrier dispensing nozzle shroud, also shown rotated about its axis 90° from its installed position.

The second nozzle for dispensing the barrier product is shown generally at 140 in FIGS. 5 and 6. The second nozzle is mounted in the housing in the cutouts 64 and extends fully across the width of the housing. It includes a wind tunnel 66 formed by two semi-cylindrical halves 142. Each wind tunnel half has a plurality of hooks 144 which engage catches 146 formed on the other half. Mounting tabs 148 are also provided for engagement with screws (not shown) which fix the wind tunnel to the housing. Slots 150 provide apertures for the barrier supply line 118 and for a motor wiring harness 152. A grating 154 is mounted near one entrance to the wind tunnel 66. The grating has a lattice of bars that permits air to enter the wind tunnel but prevent solid objects from entering. A fan 156 is mounted in the wind tunnel 66. The fan is driven by a fan motor 158. The fan motor mounts a fan shroud 160. The fan shroud is made of two shroud halves, each of which includes a body portion 162 and a wing 164 (FIG. 6). The body and wing direct air through the wind tunnel 66. The barrier supply line 118 extends through the interior of the fan shroud 160. The barrier supply line has a radial portion that extends through the aperture 150 in the wind tunnel to connect to the liquid pump. An axial portion of the barrier supply line 118 runs through the fan shroud 160 to a nozzle tube support member 166. The support member is clamped between the edges of the wind tunnel. The support member 166 mounts a barrier fluid emitter 168 that is in fluid communication with the end of the axial portion of the barrier supply line 118. The emitter 168 produces a fan-shaped spray pattern in a vertical orientation. The end of the wind tunnel 66 communicates with a cylindrical second nozzle shroud 16. The shroud is axially aligned with the wind tunnel. Shroud 16 is fixed to the housing by the knurled collar 20. The axis of the second nozzle is disposed parallel to the bottom and top walls of the housing. Thus, when the housing is in its normal orientation wherein the bottom wall is parallel to the ground, the second nozzle will dispense the barrier product in a generally horizontal direction. The combination of the air flow through the wind tunnel 66 and the liquid emitter 168 produces a barrier product spray having droplet sizes of about 80 to 200 microns in volume median diameter. This droplet size allows the barrier product droplets to penetrate a greater distance than the ULV spray and it also allows the barrier product to coat area foliage with a repellant layer that discourages mosquitoes from entering the protected zone.

Figure 7:
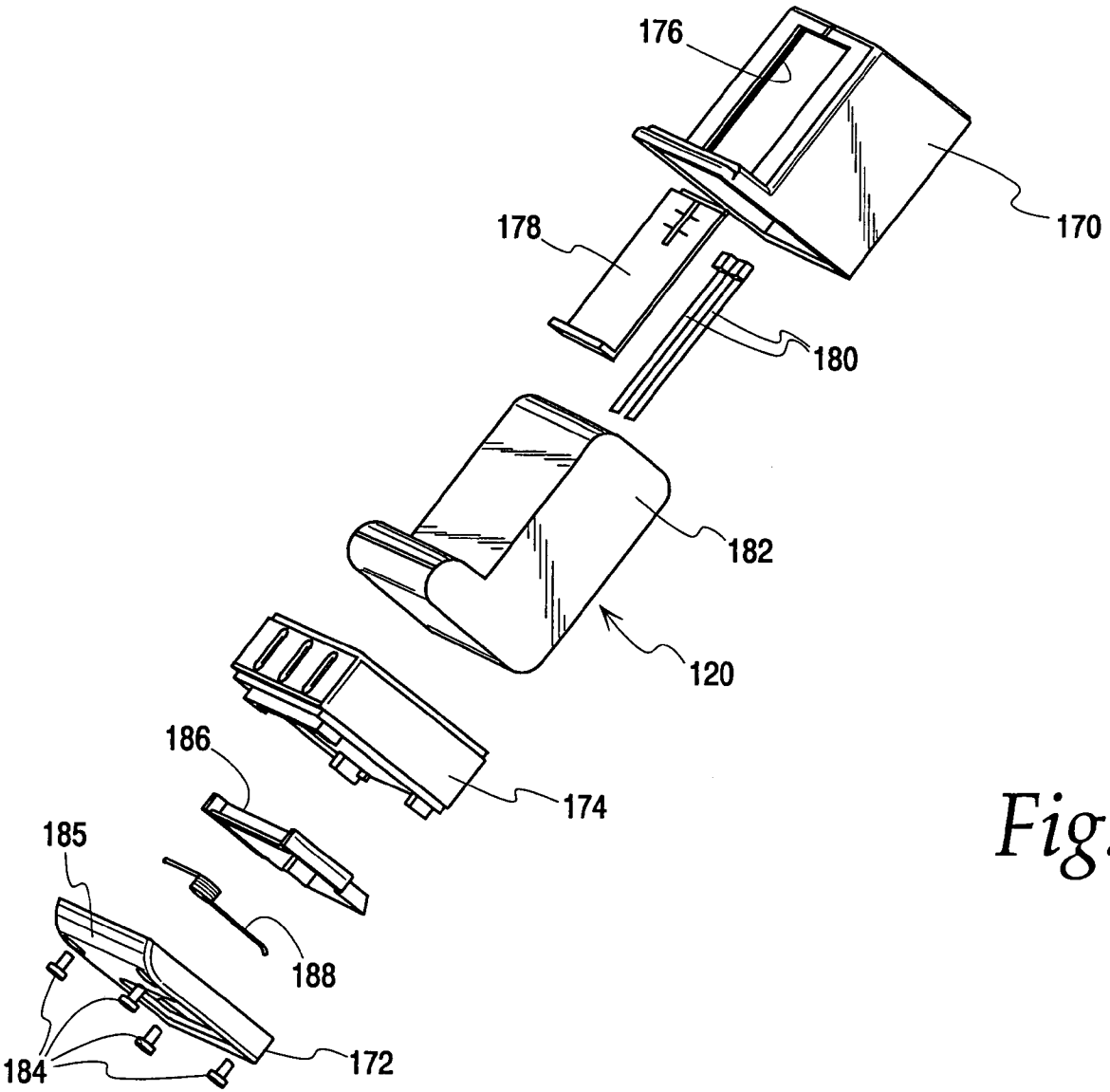
FIG. 7 is an exploded perspective view of the battery pack.
Figure 8:
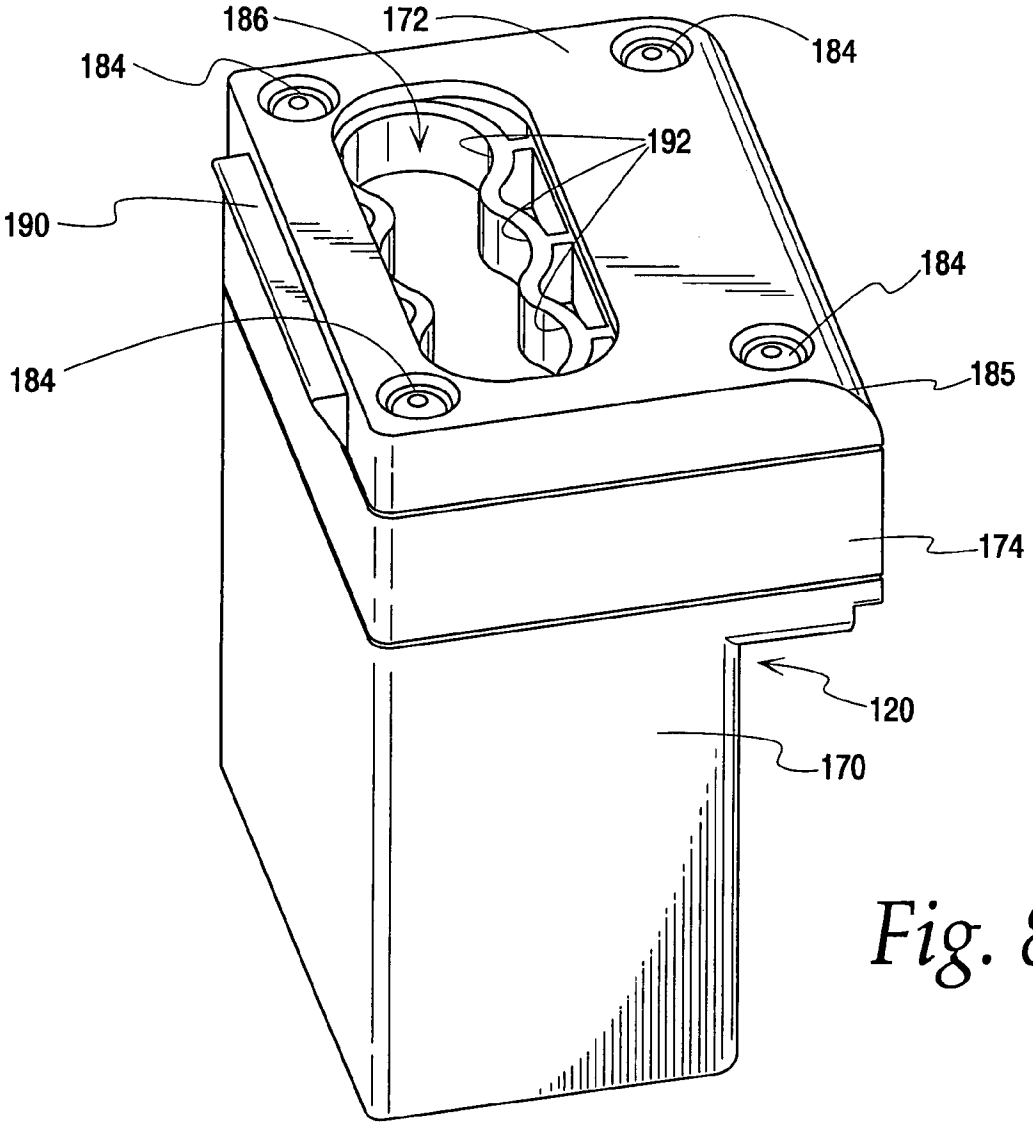
FIG. 8 is a perspective view of the underside of the battery pack, showing the latch.

The battery pack 120 is illustrated in FIGS. 7 and 8. It has a case including a top 170, a bottom 172, and a false bottom 174. The top 170 is closed on three sides and one end. The fourth, open side 176 of the top receives a contact support member 178. Battery contact strips 180 are attached to the support member 178. The contact strips provide electrical connection to a package of battery cells shown at 182. Most of the cell package fits into the top 170 of the case. The remainder fits into the false bottom 174. The false bottom is a four-sided structure with open ends. The bottom portion 172 is fastened to the false bottom 174 by screws 184. The bottom 172 is a tray having a curved edge 185 and openings on it lower surface and on one side edge. A latch 186 is slidably mounted in the bottom portion 172. A spring 188 urges the latch 186 outwardly of the bottom 172 but only a beveled edge 190 of the latch can fit through the side opening of the bottom portion. The remainder of the latch is retained in the bottom portion 172. When the beveled edge 190 protrudes from the bottom it is engageable with the catch 88 on the sprayer housing to retain the battery pack in the battery compartment 72. The latch 186 can also be retracted fully into the bottom portion 172 so as to release the battery pack 120 from the sprayer housing. The latch 186 includes a series of grooves 192 that are accessible to a user through the lower opening in the bottom portion. The user can place a thumb on the curved edge 185 and two or three fingers in the grooves 192 to enable the user to squeeze the latch and retract it for the purpose of releasing the battery pack from the sprayer housing. Installing a replacement battery pack simply requires pushing the battery pack into the compartment 72. The beveled edge of the latch will allow it to retract upon contact with the catch 88 during insertion. Once the latch clears the catch, the spring 188 will push the latch back into its extended position where it will engage the catch and hold the battery pack in the battery compartment.

FIG. 2 illustrates an auxiliary battery pack 194 resting in a charge receptacle 196 in the cradle 36. The cradle also includes a depression 198 for receiving the sprayer. The auxiliary battery pack 194 will be charged and ready to swap with a discharged battery in the sprayer. Obviously it is intended that the discharged pack will be placed in the charge receptacle 196 so it can be recharged. As mentioned above, when the sprayer is returned to the depression 198 in the cradle 36, the battery pack that is mounted in the sprayer will also be recharged. Thus, two fully charged battery packs should be available at the start of most uses of the sprayer. Two charged batteries will be sufficient to treat the yards of most homeowners.

The use and operation of the sprayer are as follows. With a fully charged battery pack and a full liquid reservoir cartridge, the user grasps the sprayer by the handle 28 and removes it from the cradle 36. The sprayer is transported to the area to be treated and, after assuring that conditions are safe for treating the area, the user acutates the control switch 30. This activates the microcontroller which first verifies that a non-empty liquid reservoir is present in the reservoir compartment 80 and that sufficient battery voltage is available to generate the required air and liquid flow rates and pressures. If so, the microcontroller activates the air pump motor 110 and the fan motor 158. Shortly thereafter the microcontroller activates the liquid pump which sends the knockdown liquid to the emitter 132 and the barrier liquid to the emitter 168. The user then traverses the perimeter of the area to be treated. If the microcontroller senses that the battery voltage has fallen below a level needed to assure proper droplet formation it will shut down the liquid pump and then the air motors. The user can then change the battery pack as described above to continue the treatment process. Similarly, if the microcontroller senses that the liquid reservoirs are empty, it will shut down the liquid pump and then the air motors. The user can then change the liquid reservoir cartridge as described above. When the entire area to be treated has been treated the user releases the control switch. The liquid pump shuts off, followed by the air motors. The user returns the sprayer and auxiliary battery pack to the charging cradle so the batteries will recharge and be ready for the next application.

While the preferred form of the invention has been shown and described herein, it should be realized that there may be many modifications, substitutions and alterations thereto. For example, instead of using a single liquid pump with dual heads, separate pumps could be provided, one for each product. Alternately, the pump could be replaced entirely by one or more aerosol pressure cans. If aerosol cans are used, they would be a replacement item just like the liquid reservoir cartridge. Also, while various components of the sprayer are referred to as being in the housing, it will be understood that this is meant in a general sense that the components are connected, attached or mounted on, in or to the housing. In other words, portions of the components may protrude outside of a boundary wall of the housing and still be considered in the housing. A further alternate construction may include a separate lever inside the door 26. Thus, instead of the door actuating the reservoir cam 106, a lever just inside the door would be connected to the cam to actuate it. Also, while a hand-held sprayer has been shown and described, other arrangements are possible that would still allow the sprayer to be portable. For example, the housing might have wheels incorporated therein or the housing could be mounted on a ground-engaging cart.

We claim:

1. A portable sprayer, comprising:

a housing having first and second nozzles mounted in the housing, the nozzles being constructed such that the droplet sizes produced by the two nozzles are different from one another;

a reservoir cartridge in the housing defining first and second liquid chambers;

pressurizing means in the housing for supplying liquid from the first and second chambers to the first and second nozzles, respectively, under pressure suitable for creating the desired droplet sizes;

air supply means in the housing for supplying air to the first and second nozzles, the pressure and volume of the supplied air being suitable for creating the desired droplet sizes; and control means in the housing for controlling operation of the pressurizing means and air supply means.

2. The sprayer of claim 1 wherein the first and second nozzles are aimed at separate target zones.

3. The sprayer of claim 2 wherein the first nozzle is aimed in a direction above horizontal and the second nozzle is aimed in a generally horizontal direction.

4. The sprayer of claim 1 wherein the first nozzle comprises an emitter which produces droplet sizes of about 15 to 30 microns in diameter.

5. The sprayer of claim 4 wherein the emitter of the first nozzle is arranged to produce a cone-shaped spray pattern.

6. The sprayer of claim 4 wherein the first nozzle is aimed at about 45° above horizontal.

7. The sprayer of claim 1 wherein the second nozzle comprises an emitter which produces droplet sizes of about 80 to 200 microns in diameter.

8. The sprayer of claim 7 wherein the emitter of the second nozzle is arranged to produce a fan-shaped spray pattern in a vertical orientation.

9. The sprayer of claim 7 wherein the second nozzle is aimed in a generally horizontal direction.

10. The sprayer of claim 1 wherein the pressurizing means includes at least one pump in fluid communication between the first and second chambers and the first and second nozzles.

11. The sprayer of claim 1 wherein the reservoir cartridge is removably mounted in the housing.

12. The sprayer of claim 11 wherein the pressurizing means further includes first and second liquid supply lines removably connectable to the liquid reservoir.

13. The sprayer of claim 1 wherein the housing further comprises a movable tray on which the reservoir cartridge is mounted, and a lever connected to the tray for effecting opening and closing movements of the tray, the tray carrying the chambers into and out of fluid communication with the pressurizing means upon closing and opening of the tray, respectively.

14. The sprayer of claim 13 wherein the pressurizing means includes at least one pump in fluid communication between the first and second chambers and the first and second nozzles, first and second liquid supply lines between the first and second chambers and the pump, and first and second quick connect fluid connectors providing fluid communication between the first and second chambers and the first and second liquid supply lines, the fluid connectors being movable into and out of engagement upon closing and opening of the tray, respectively.

15. The sprayer of claim 1 further comprising a rechargeable battery pack removably mounted in the housing.

16. The sprayer of claim 15 wherein the battery pack includes a false bottom, a latch slidably mounted in the false bottom between open and closed positions, the latch engaging the housing when in the closed position to retain the battery pack in the housing, and a spring biasing the latch to the closed position.

17. The sprayer of claim 16 wherein the latch further includes a plurality of finger openings engageable by a user to move the latch to the open position to release it from the housing and permit removal of the battery pack.

18. The sprayer of claim 1 wherein the air supply means includes a wind tunnel mounted in the housing, and a fan mounted in the wind tunnel.

19. The sprayer of claim 1 wherein the air supply means includes an air pump.

20. The sprayer of claim 19 wherein the air supply means further includes a wind tunnel mounted in the housing, and a fan mounted in the wind tunnel.

21. The sprayer of claim 1 wherein the control means includes an electrical circuit which turns on the air supply means before turning on the pressurizing means.

22. The sprayer of claim 1 wherein the control means includes an electrical circuit which turns off the air supply means after turning off the pressurizing means.

23. The sprayer of claim 1 wherein the control means includes an electrical circuit which turns on the air supply means before turning on the pressurizing means and turns off the air supply means after turning off the pressurizing means.

24. The sprayer of claim 1 wherein the control means includes an electric circuit which prevents activating the pressurizing means and the air supply means if the reservoir cartridge is missing or empty.

25. The sprayer of claim 1 further comprising:

a rechargeable battery pack removably mounted in the housing; and a charging cradle having a receptacle for receiving the housing and charging jack electrically engageable with the battery pack.

26. The sprayer of claim 25 wherein the control means includes an electric circuit which prevents activating the pressurizing means and the air supply means if at least one fault condition exists, the fault conditions including the housing is sitting in the cradle, the battery pack is being charged, and the battery pack power is low.

27. The sprayer of claim 25 wherein the cradle further comprises a receptacle and charging jack for an auxiliary battery pack.

28. A portable sprayer, comprising:

a housing having first and second nozzles mounted in the housing, the nozzles being aimed at separate target zones;

a reservoir cartridge in the housing defining first and second liquid chambers;

pressurizing means in the housing for supplying liquid from the first and second chambers to the first and second nozzles, respectively, under pressure suitable for creating the desired droplet sizes;

air supply means in the housing for supplying air to the first and second nozzles, the pressure and volume of the supplied air being suitable for creating the desired droplet sizes; and control means in the housing for controlling operation of the pressurizing means and air supply means.

29. The sprayer of claim 28 wherein the first nozzle is aimed in a direction above horizontal and the second nozzle is aimed in a generally horizontal direction.

30. The sprayer of claim 28 wherein the first nozzle comprises an emitter which produces droplet sizes of about 15 to 30 microns in diameter.

31. The sprayer of claim 30 wherein the emitter of the first nozzle is arranged to produce a cone-shaped spray pattern.

32. The sprayer of claim 30 wherein the first nozzle is aimed at about 45° above horizontal.

33. The sprayer of claim 28 wherein the second nozzle comprises an emitter which produces droplet sizes of about 80 to 200 microns in diameter.

34. The sprayer of claim 33 wherein the emitter of the second nozzle is arranged to produce a fan-shaped spray pattern in a vertical orientation.

35. The sprayer of claim 33 wherein the second nozzle is aimed in a generally horizontal direction.

36. The sprayer of claim 28 wherein the pressurizing means includes at least one pump in fluid communication between the first and second chambers and the first and second nozzles.

37. The sprayer of claim 28 wherein the reservoir cartridge is removably mounted in the housing.

38. The sprayer of claim 37 wherein the pressurizing means further includes first and second liquid supply lines removably connectable to the liquid reservoir.

39. The sprayer of claim 28 wherein the housing further comprises a movable tray on which the reservoir cartridge is mounted, and a lever connected to the tray for effecting opening and closing movements of the tray, the tray carrying the chambers into and out of fluid communication with the pressurizing means upon closing and opening of the tray, respectively.

40. The sprayer of claim 39 wherein the pressurizing means includes at least one pump in fluid communication between the first and second chambers and the first and second nozzles, first and second liquid supply lines between the first and second chambers and the pump, and first and second quick connect fluid connectors providing fluid communication between the first and second chambers and the first and second liquid supply lines, the fluid connectors being movable into and out of engagement upon closing and opening of the tray, respectively.

41. The sprayer of claim 28 further comprising a rechargeable battery pack removably mounted in the housing.

42. The sprayer of claim 41 wherein the battery pack includes a false bottom, a latch slidably mounted in the false bottom between open and closed positions, the latch engaging the housing when in the closed position to retain the battery pack in the housing, and a spring biasing the latch to the closed position.

43. The sprayer of claim 42 wherein the latch farther includes a plurality of finger openings engageable by a user to move the latch to the open position to release it from the housing and permit removal of the battery pack.

44. The sprayer of claim 28 wherein the air supply means includes a wind tunnel mounted in the housing, and a fan mounted in the wind tunnel.

45. The sprayer of claim 28 wherein the air supply means includes an air pump.

46. The sprayer of claim 45 wherein the air supply means farther includes a wind tunnel mounted in the housing, and a fan mounted in the wind tunnel.

47. The sprayer of claim 28 wherein the control means includes an electrical circuit which turns on the air supply means before turning on the pressurizing means.

48. The sprayer of claim 28 wherein the control means includes an electrical circuit which turns off the air supply means after turning off the pressurizing means.

49. The sprayer of claim 28 wherein the control means includes an electrical circuit which turns on the air supply means before turning on the pressurizing means and turns off the air supply means after turning off the pressurizing means.

50. The sprayer of claim 28 wherein the control means includes an electric circuit which prevents activating the pressurizing means and the air supply means if the chambers are missing or empty.

51. The sprayer of claim 28 further comprising:

a rechargeable battery pack removably mounted in the housing; and a charging cradle having a receptacle for receiving the housing and charging jack electrically engageable with the battery pack.

52. The sprayer of claim 51 wherein the control means includes an electric circuit which prevents activating the pressurizing means and the air supply means if at least one fault condition exists, the fault conditions including the housing is sitting in the cradle, the battery pack is being charged, and the battery pack power is low.

53. The sprayer of claim 51 wherein the cradle further comprises a receptacle and charging jack for an auxiliary battery pack.

54. A portable sprayer, comprising:

a housing having first and second nozzles mounted in the housing;

a reservoir cartridge in the housing defining first and second liquid chambers;

a liquid pump in the housing and driven by an electric motor for supplying liquid from the first and second chambers to the first and second nozzles, respectively;

an air pump in the housing and driven by an electric motor air for supplying air to the first nozzle;

a fan in the housing and driven by an electric motor air for supplying air to the second nozzle;

control means in the housing for controlling operation of the liquid pump, the air pump and the fan; and a rechargeable battery pack for supplying electric power to the liquid pump, air pump and fan motors.

55. The portable sprayer of claim 54 wherein the first nozzle has an emitter arranged to produce droplet sizes of about 15 to 30 microns in diameter, and the liquid pump and air pump motors together draw about 2 to 3 amps of current.

56. A portable sprayer, comprising:

a housing having first and second nozzles mounted in the housing;

a reservoir cartridge in the housing defining first and second liquid chambers;

pressurizing means in the housing for supplying liquid from the first and second chambers to the first and second nozzles, respectively, under pressure suitable for creating the desired droplet sizes;

air supply means in the housing for supplying air to the first and second nozzles, the pressure and volume of the supplied air being suitable for creating the desired droplet sizes;

control means in the housing for controlling operation of the pressurizing means and air supply means;

a rechargeable battery pack removably mounted in the housing, the battery pack including a case, a latch slidably mounted in the case between open and closed positions, the latch engaging the housing when in the closed position to retain the battery pack in the housing, and a spring biasing the latch to the closed position.

57. The sprayer of claim 56 wherein the latch further includes a plurality of grooves arranged opposite an edge of the case such that the grooves and edge are engageable with one hand to move the latch to the open position to release it from the housing and permit removal of the battery pack.

58. A portable sprayer for dispersing mosquito control products including a knockdown product and a baffler product, comprising:

a housing having a first nozzle for dispersing the knockdown product as a ULV fog and a second nozzle for dispersing the baffler product in a spray, both nozzles being mounted in the housing;

a reservoir cartridge in the housing defining first and second liquid chambers, the first chamber containing the knockdown product, the second chamber containing the barrier product;

a liquid pump in the housing and driven by an electric motor for supplying liquid from the first and second chambers to the first and second nozzles, respectively;

an air pump in the housing and driven by an electric motor air for supplying air to the first nozzle;

a fan in the housing and driven by an electric motor air for supplying air to the second nozzle;

control means in the housing for controlling operation of the liquid pump, the air pump and the fan; and a rechargeable battery pack for supplying electric power to the motors.

59. The sprayer of claim 58 wherein the first and second nozzles are aimed at separate target zones.

60. The sprayer of claim 59 wherein the first nozzle is aimed in a direction above horizontal and the second nozzle is aimed in a generally horizontal direction.

61. The sprayer of claim 58 wherein the first nozzle comprises an emitter which produces droplet sizes of about 15 to 30 microns in diameter.

62. The sprayer of claim 61 wherein the emitter of the first nozzle is arranged to produce a cone-shaped spray pattern.

63. The sprayer of claim 61 wherein the first nozzle is aimed at about 45° above horizontal.

64. The sprayer of claim 58 wherein the second nozzle comprises an emitter which produces droplet sizes of about 80 to 200 microns in diameter.

65. The sprayer of claim 64 wherein the emitter of the second nozzle is arranged to produce a fan-shaped spray pattern in a vertical orientation.

66. The sprayer of claim 64 wherein the second nozzle is aimed in a generally horizontal direction.

* * * * *